United States Patent [19]

Mens Franciscus et al.

[11] 4,357,007

[45] Nov. 2, 1982

[54] SINGLER DEVICE

[75] Inventors: Willy A. Mens Franciscus, Wommelgem; Ludovicus Van Dorst, Kapellen, both of Belgium

[73] Assignee: International Standard Electric Corporation, New York, N.Y.

[21] Appl. No.: 143,383

[22] Filed: Apr. 24, 1980

[51] Int. Cl.[3] ..... B65H 3/12; B65H 7/12; B65H 7/16

[52] U.S. Cl. ..... 271/96; 271/111; 271/12

[58] Field of Search ..... 271/94, 95, 96, 34, 271/35, 110, 111, 11-15, 37, 38

[56] References Cited

U.S. PATENT DOCUMENTS 3,730,514 5/1973 Burkhardt ..... 271/96
3,927,876 12/1975 Wojtowicz ..... 271/37
3,981,493 9/1976 Klappenecker ..... 271/111
3,988,017 10/1976 Kyhl ..... 271/111
4,030,722 6/1977 Irvine ..... 271/111

*Primary Examiner*—John J. Love
*Assistant Examiner*—Brian Bond
*Attorney, Agent, or Firm*—John T. O'Halloran; David M. Quinlan

[57] ABSTRACT

A singler device which includes an input position with a first and second suction means mounted along one face of a traveling suction belt, a passage, and a delivery position with first and second detector members. The second detector member operates the first or second suction means depending on the first detector member being in its non-operated or operated condition, respectively. The use of this device permits flat articles to be separated from a stack in the correct order even when they are misaligned to a certain extent.

7 Claims, 5 Drawing Figures

SINGLER DEVICE

The present invention relates to a singler device for flat articles, e.g. letters, including first and second article driving means to engage and drive said flat articles sequentially off a stack located in an input position and sideways therefrom via a passage into a delivery position laterally separated from said input position by lateral guiding means for said flat articles, and article detector means mounted in said delivery position for controlling said driving means.

Such a singler device is already known from U.S. Pat. No. 2,970,834. In this known device the first driving means is mounted in the input position close to the guiding means, whereas the second driving means is mounted in the delivery position. These driving means are operated in succession subsequent to the detector means having detected the passage of the trailing edge of a letter.

A drawback of this known device is that due to the first driving means being mounted close to the guiding means comprising a guide plate even a small misalignment with respect to the guide plate between two consecutive letters in the input position may give rise to an erroneous operation. Indeed, when for instance the leading edge of two such consecutive letters of the stack are misaligned to such an extent that the second letter instead of the first one is positioned in front of the first driving means the second letter and not the first one will be carried away off the stack when this driving means is operated.

Separate means might be provided to align the leading edges of the letters on the guide plate but this requires additional equipment.

An object of the present invention is therefore to provide a singler device of the above type but which does not present this drawback, i.e. wherein the flat articles are separated from the stack in the correct order even when they are misaligned to a certain extent.

According to the invention this object is achieved due to the fact that said singler device is characterized in that said article detector means include first and second detector members, that said first and second driving means are both mounted in said input position, said first and second driving means and said first and second detector members being arranged in succession along the path followed by an article from said input position to said delivery position and that said second detector member subsequent to having been operated operates said first or second driving means depending on said first detector member being in its non-operated or operated condition respectively.

In this way the misalignment between two consecutive articles of the stack may be relatively large before it gives rise to an erroneous operation. More particularly, at the start of a singling operation, i.e. after a stack has been brought in the input position the maximum permissible misalignment is substantially equal to the distance between the first driving means and the guiding means comprising a guide plate. Indeed, when for instance the leading edge of the first of these two articles makes contact with the guide plate, whilst the second article is still positioned in front of the first driving means the latter driving means will be operated, due to the first detector member being inoperative, so that notwithstanding this misalignment the first article will be carried off the stack.

The present invention also relates to a vibration damping material comprising two metal outer layers secured to both sides of an inner layer.

Such a vibration damping material is well known in the art. It is for instance mentioned in the article "Development of Silentalloy Hidamet" by K. Amano et al., Toshiba Review, No 99, Sept.-Oct. 1975, pp 29–32.

An object of the present invention is to provide an improved vibration damping material of the above type.

According to the invention this object is achieved due to the fact that said two metal layers are layers of aluminium and lead having different thickness respectively, whilst said inner layer is made of a plastic material.

The above mentioned and other objects and features of the invention will become more apparent and the invention itself will be best understood by referring to the following description of an embodiment taken in conjunction with the accompanying drawings in which.

Figure 3:
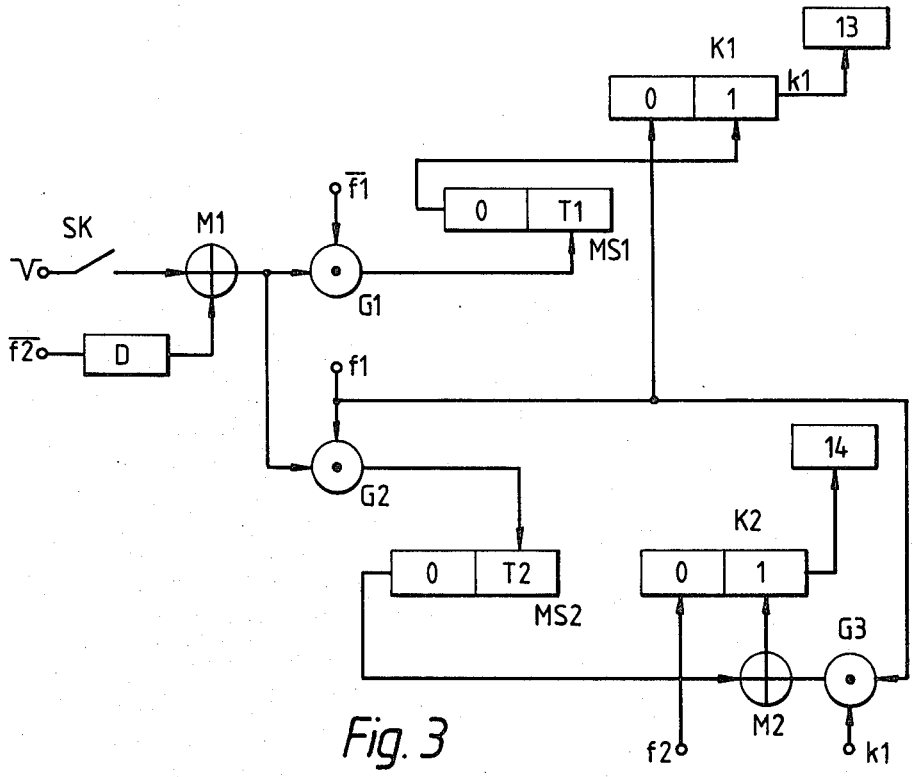
Figure 4:
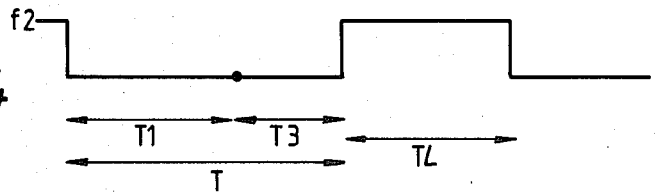
Figure 5:
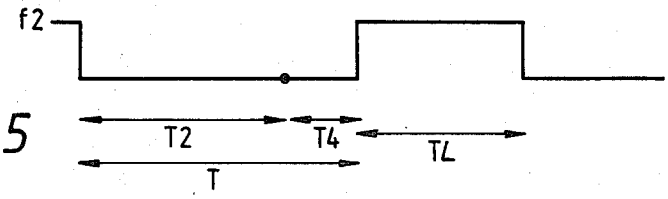

FIG. 3 schematically shows the electric monitoring circuit according to the present invention;

FIGS. 4 and 5 are pulse diagrams to illustrate the operation of the device.

Figure 1:
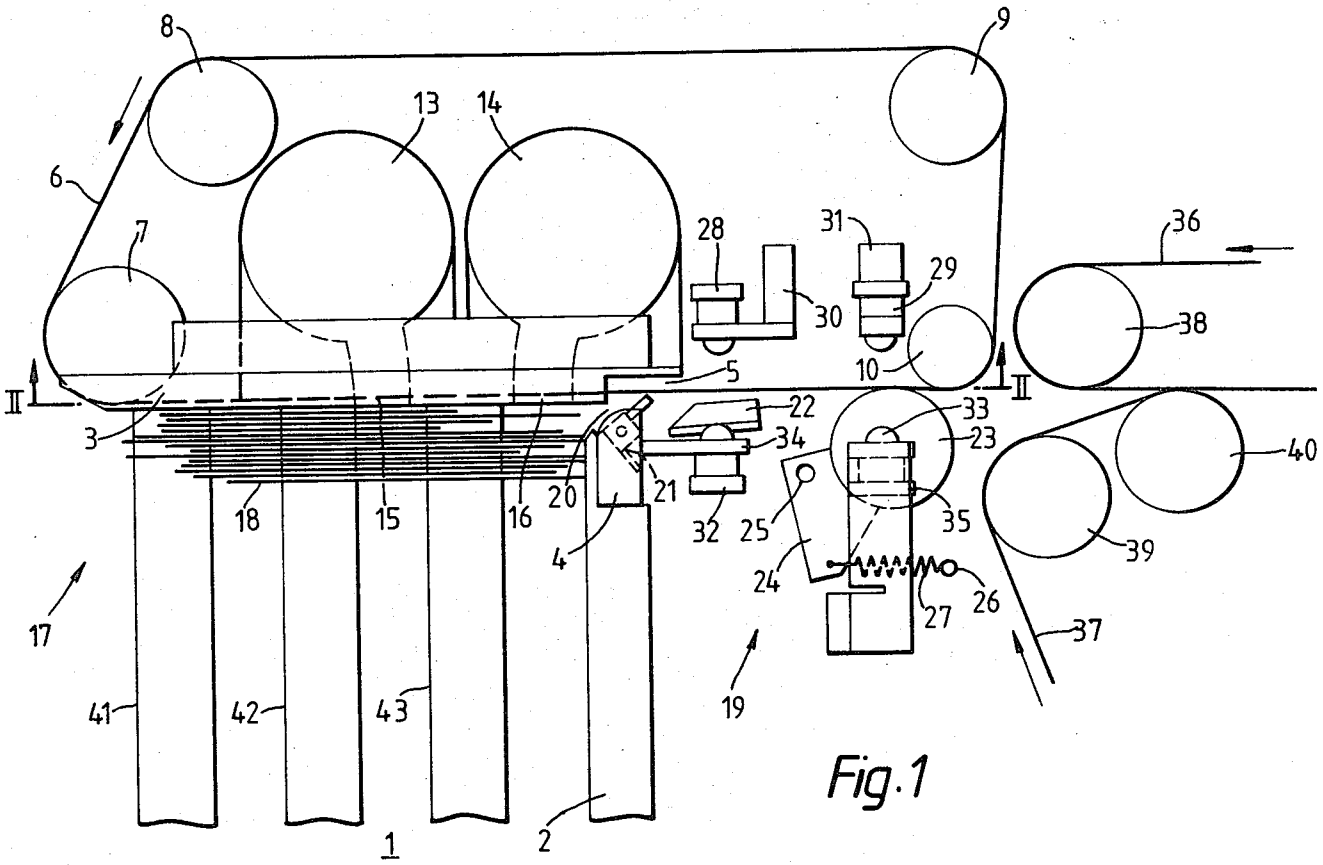
FIG. 1 is a top view of a singler device according to the present invention, an electric monitoring circuit forming part of this device being however not shown.
Figure 2:
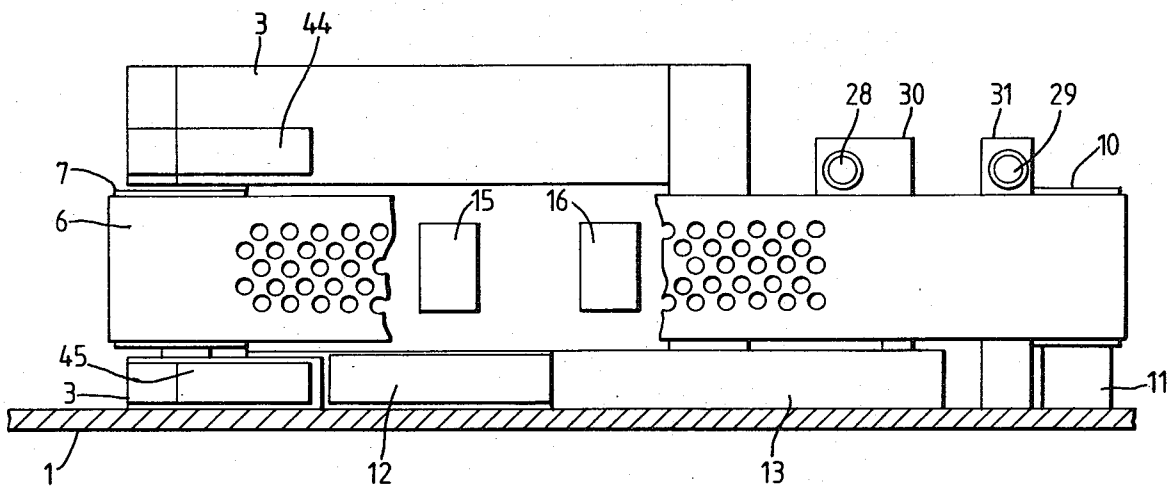
FIG. 2 is a cross-section along line II—II of FIG. 1.

The singler device as shown in FIGS. 1 and 2 includes a horizontal bottom plate 1 on which are mounted a vertical lateral guide plate 2 and an L-shaped front plate 3. These plates 2 and 3 have cut-out end portions 4 and 5 respectively. An endless perforated belt 6 runs over rollers 7, 8, 9 and 10 and between parts of the front plate 3 which are disposed in the plane of the belt 6. The guide rollers 7, 8 and 9 are idlers mounted on axles fixed on the bottom plate 1, whilst roller 10 is a drive roller mounted on a shaft 11 of a drive motor (not shown). A feeler 12 of a microswitch is mounted between lower portions of the front plate 3 to which strips 44, 45 made of a friction material are affixed. Suction devices 13 and 14 are secured to the front plate 3 and have suction openings 15 and 16 terminating behind the belt. These suction devices are for instance diaphragm valves of the type disclosed in British Pat. No. 1,225,562. Each of these suction devices is able to create an underpressure or not in its suction opening.

The bottom plate 1, the lateral guide plate 2, the front plate 3 and a portion of the belt 6 define an input position 17 for a stack 18 of letters or other flat articles. This stack 18 is urged gently towards the working face of the perforated belt 6, for instance by means of a pusher plate (not shown) such as described and shown in the above mentioned U.S. Pat. No. 2,970,834 and aided by three auxiliary feeder belts 41, 42, 43 with their working faces supporting the letters running toward and transversaly of the working surface of the suction belt 6. The motor (not shown) driving the feeder belts 41, 42, 43 is controlled by the microswitch feeler 12.

The input position 17 communicates with a delivery position 19 via a passage 20 delimited by the portion of the belt 6 located in front of the cut-out portion 5 of front plate 3 and the end portion of the lateral guide plate 2. A separator 21 comprising a freely rotatable vertical piece having a substantially L-shaped cross-section is mounted on the bottom plate 1 and in the cut-out portion 4 of the lateral guide plate 2. By not shown spring means the separator 21 is continuously urged into contact with the portion of the belt 6 located in front of the cut-out portion 5 so as to normally close the above passage 20.

Considered in the direction of advancement of the belt 6 the separator 21 is followed by a suction chamber 22 wherein an underpressure is continuously created and by a pressure roller 23. The latter roller 23 is an idler roller mounted on a bracket 24 which is able to pivot about axle 25 fixed on bottom plate 1 and connected to a fixed pin 26 through a spring 27 which continuously urges the roller 23 into contact with the belt 6.

The delivery position 19 also includes two electric detector members each comprising a light emitting diode and a photocell mounted in front of each other above the belt and at either side thereof. Light emitting diodes 28 and 29 are mounted on brackets 30 and 31 respectively, whilst photocells 32 and 33 are mounted on the supports 34 and 35 respectively.

Finally, the delivery position 19 is followed by a pair of belts 36, 37 carried by rollers 38 and 39, 40 respectively, the belts moving in the direction of the arrows.

Referring to FIG. 3 the electric monitoring circuit shown therein includes:

bistable circuits K1 and K2 controlling the suction devices 13 and 14 respectively;

monostable circuits MS1 and MS2 with time constants T1 and T2 respectively;

a differentiator D;

AND-gates G1, G2, G3 and OR-gates M1 and M2;

a start key SK connected to an operating voltage V.

The operation of the above described singler device is described hereinafter by making reference to FIGS. 1 to 3 and to FIGS. 4 and 5.

Hereby it is supposed that initially no letters are present in the device so that both the photocells 32 and 33 are illuminated by their associated light emitter diodes 28 and 29 respectively as a consequence of which both the inverse outputs f1 and f2 of these photocells are activated (or on 1).

After a stack 18 of letters has been put in the input position 17 the start key SK (FIG. 3) is temporarily operated to trigger the monostable circuit MS1 to its unstable condition via the OR-gate M1 and the AND-gate G1 which is enabled due to the inverse output f1 being activated. After a time interval T1 has elapsed the 0-output of the monostable circuit MS1 becomes activated, as a consequence of which the bistable circuit K1 is triggered to its 1-condition wherein it operates the suction device 13 (FIG. 4). This device then exerts a suction in the suction opening 15 so that the suction belt 6 starts moving the terminal letter off the stack 18 sideways from the input position 17 into the delivery position 19 against the action of the friction strips 44, 45. Hereby the leading edge of this terminal letter is displaced past the separator 21 and in front of the suction chamber 22, both these elements restraining advancement by the belt 6 of all but this terminal letter. Thus, letters which are possibly erroneously displaced with this terminal letter, e.g. due to the fact that they adhere thereto by friction, are substantially prevented from entering the delivery position 19.

When the leading end portion of the terminal letter is detected by the photocell 32 the output f1 thereof becomes activated as a consequence of which the bistable circuit K1 is reset to its 0-condition. Also the suction device 13 then becomes inoperative. However, simultaneously with the bistable circuit K1 being reset the bistable circuit K2 is triggered to its 1-condition via the AND-gate G3 and the OR-gate M2 as the 1-output k1 of the bistable circuit K1 is then still activated. Due to this the suction device 14 is then operated so that the perforated belt 6 displaces the above terminal letter further into the delivery position 19 from the suction chamber 22 towards the pressure roller 23.

When the leading edge of this letter is detected by the photocell 33 the output f2 thereof becomes activated as a consequence of which the bistable circuit K2 is reset to its 0-condition (FIG. 4). Also the suction device 14 then becomes inoperative. However, at that moment the leading edge of the terminal letter is seized between the pressure roller 23 and the belt 6 and carried further until it is seized between the belts 36 and 37.

Upon the rear edge of the terminal letter leaving the photocell 33 the inverse output f2 thereof becomes activated so that a trigger pulse is produced at the output of the differentiator D and therefore at the output of the OR-gate M1. As a consequence either the monostable circuit MS1 or the monostable circuit MS2 is triggered to its 1-condition via the AND-gate G1 or G2 depending on the output f1 or f1 of the photocell 32 being activated at that moment respectively i.e. on a letter following the above mentioned terminal letter, hereinafter called second letter, being absent or present in front of this photocell 32 respectively.

Normally, no such second letter is located in front of the photocell 32 and in this case the operation is as described above.

On the contrary when such a second letter is located in front of this photocell 32 due to the fact that it has for instance been carried off the stack together with the above mentioned terminal letter, the monostable circuit MS2 is triggered to its unstable condition (FIG. 5). After a time interval T2 has elapsed the 0-output of the monostable circuit MS2 becomes activated as a consequence of which the bistable circuit K2 is triggered to its 1-condition wherein it operates the suction device 14 so that the perforated belt 6 displaces the above second letter further into the delivery position. The rest of the operation is as already described above.

The reason of the above mentioned time intervals T1 and T2 is explained hereinafter. Hereby reference is made to FIGS. 4 and 5 wherein the length of the terminal letter corresponds to a time interval TL.

The distance between two consecutive letters, such as the above mentioned terminal letter and second letter, must at least be equal to a minimum value in order that sufficient time should be available to perform other operations, such as for instance the control of a points mechanism. This distance is supposed to correspond to a time interval T, taking the operation speed into account. This means that the time interval elapsing between the moment at which the trailing edge of the terminal letter leaves the photocell 33 and the moment at which the suction device 13 (FIG. 4) or 14 (FIG. 5) is operated to displace the second letter should be such that the leading edge of this second letter comes in front of the photocell 33 after a time interval T.

As described above the suction device 13 is operated when the second letter is not located in front of the photocell 32 at the moment the terminal letter leaves photocell 33. This second letter is closest to the photocell 32 when its leading edge is about to come in front of this photocell 32. Supposing that in this case a time interval T3 (FIG. 4) is required to reach the photocell 33 it is clear that instead of operating the suction device 13 only a time interval T after the trailing edge of the terminal letter has left the photocell 33, in which case the second letter would only reach the photocell after a time interval T+T3, this suction device 13 can already be operated a time interval T1=T-T3 after the trailing edge of the terminal letter has left the photocell 33. In this case the second letter will reach the photocell 33 after the minimum time interval T. Thus the operating speed of the device is increased.

As also described above, the suction device 14 is operated when the second letter is located in front of the photocell 32. This letter is closest to the photocell 33 when its leading end portion is about to come in front of the latter photocell e.g. when it is at about 5 mm from the photocell 33 which is in line with the point at which the pressure roller 23 makes contact with the belt 6. Because in this case a time interval T4 is required to reach the photocell 33 it is clear that when the suction device 14 is operated a time interval T2=T-T4 after the trailing edge of the terminal letter has left the photocell 33 the second letter will again reach the photocell 33 after the minimum time interval T has elapsed.

The minimum letter length able to be correctly processed is considered hereinafter.

As described above, if the second letter is not located in front of the photocell 32 at the moment the trailing edge of the terminal letter leaves the photocell 33 the second letter will be advanced, a time interval T1 later, by the cooperation of the belt 6 and the suction device 13. This means that at the moment the leading edge of this second letter is in front of the photocell 32 the trailing edge of this letter should still be completely in front of the suction device 13 in order to prevent a third letter following the second letter to be displaced by this suction device. Hence, the minimum letter length able to be processed by the present device is substantially equal to the distance separating the suction device 13 and the photocell 32.

Similarly and as also described above, if the second letter is located in front of the photocell 32 at the moment the trailing edge of the terminal letter leaves the photocell 33 the second letter will be advanced, a time interval T2 later, by the cooperation of the belt 6 and the suction device 14. This means that at the moment the leading edge of this second letter is in front of the photocell 33 the trailing edge of this letter should still be completely in front of the suction device 14 in order to prevent a third letter following the second one to be displaced by this suction device. Hence, the minimum letter length able to be processed by the present device is also substantially equal to the distance between the trailing end portion of the suction device 14 and the photocell 33.

The choice of the relative position of the suction devices 13, 14 and of the photocells 32, 33 will be explained hereinafter.

At the start of an operation the maximum permissible misalignment of the front edges of the letters of the stack 18 is equal to the distance between the leading edge of the suction device 13 and the guide plate 2 because when the leading edge of a first letter coincides with the leading edge of the suction device 13 and the leading edge of the second letter following the first one makes contact with the guide plate the suction device 13 will be operated because no letter is situated in front of the photocell 32, so that—as it should be—the first letter will be carried off the stack 18 by the belt 6. On the contrary, if the misalignment is larger the second letter instead of the first one will be displaced from the input position towards the delivery position 19. It is clear that to have the maximum permissible misalignment at the start of an operation the distance between the suction device 13 and the guide plate 2 should be a maximum i.e. the plate 2 should be mounted as close to the photocell 32 as possible. However, the distance between the guide plate 2 and the photocell 32 should be sufficient to mount the separator 21 and the suction chamber 22 so that this limits the maximum permissible alignment.

During operation the maximum permissible misalignment of the front end portions of the letters of the stacks 18 is somewhat smaller than that at the start of an operation because of the space required by the suction device 14. Indeed, this misalignment is equal to the distance between the leading edge of the suction device 14 and the photocell 32 because when the leading edge of a first letter coincides with the leading edge of the suction device 14 and the leading edge of the second letter following the first one is situated in front of the photocell 32 the suction device 14 will be operated, so that—as it should be—the first letter will be carried off the stack by the belt 6. On the contrary, if the misalignment is larger the second letter instead of the first will be displaced towards the delivery position 19.

It is clear that to have the maximum permissible misalignment during operation the distance between the suction device 14 and the photocell 32 should be a maximum i.e. the suction device 14 should be as close as possible to suction device 13. But since the distance between the suction device 14 and the photocell 33 is equal to the minimum letter length this means that the photocell 33 should also be as close as possible to the photocell 32. However between the photocells 32 and 33 sufficient room should be provided to mount the elements 21, 22 and 23.

Since vibrations introduced by the driving mechanism and particularly the rollers can create excessive noise, it is desirable to reduce them by making the bottom plate 1 out of a suitable vibration damping material. The following sandwich material composition comprising two metal layers enclosing a layer of organic material produced adequate results:

3 to 10 millimeters, e.g. 10 millimeters of aluminium;
1 to 3 millimeters, e.g. 1 millimeter, of lead;
0.2 to 2 millimeters, e.g. 0.5 millimeter of soft polyvinylchloride.

Soft polyvinylchloride has a hardness between 60 and 80 Shore A.

While the principles of the invention have been described above in connection with specific apparatus, it is to be clearly understood that this description is made only by way of example and not as a limitation on the scope of the invention.

We claim:

1. A singler device for flat articles having an input stage for storing a plurality of articles to be singulated and a delivery stage for accepting articles from said input stage and feeding singulated articles to an output, the device comprising:

a movable drive belt for carrying said articles from said input stage to said delivery stage;

first holding means in said input stage for holding an article on said moving drive belt when said first holding means is activated;

second holding means spaced downstream from said first holding means along the direction of travel of said drive belt for holding an article on said moving drive belt when said second holding means is activated;

first and second sensor means in said delivery stage for providing a signal upon detection of the presence or absence of an article on said belt, wherein said first sensor means is spaced upstream from said second sensor means along the direction of travel of said belt;

delivery means for feeding singulated articles that reach said second sensor means to an output;

separator means for inhibiting the transfer of more than one article at a time into said delivery stage from said input stage and for holding at said first sensor means all but one article that enters said delivery stage; and control means for selectively operating said holding means in response to signals from said sensor means, saic control means operating in a cycle beginning at time=0, defined as the time said second sensor means detects the absence of an article on said belt, wherein:

(a) if said first sensor means detects the absence of an article at time=0, said control means activates said first holding means at time=T1 for delivery of at least one article into said delivery stage to said first sensor means to cause said control means to deactivate said first holding means and activate said second holding means for delivery of a singulated one of said at least one article to said second sensor means, or, if said first sensor means detects the presence of an article at time=0, said control means activates said second holding means at time=T2 for delivery to said second sensor means of said article at said first sensor means to singulate said article, and (b) said control means deactivates said second holding means when said second sensor means detects said singulated article.

2. A singler device according to claim 1, wherein said first and second holding means comprise first and second stationary suction means mounted along one face of a traveling suction belt comprising said drive belt and said suction means are operable to cause suction engagement of the flat articles from a stack onto said belt.

3. A singler device according to claim 2, wherein the distance between said first suction means and said first sensor means is substantially equal to the minimum length of the flat articles.

4. A singler device according to claim 2, wherein the distance between said second suction means and said second sensor means is substantially equal to the minimum length of the flat articles.

5. A singler device according to claim 2, wherein said delivery means comprises a pressure roller cooperative with the drive belt to grip and advance the leading edge of a flat article detected by said second sensing means.

6. A singler device according to claim 2 wherein said separator means comprises:

a guide plate for engaging the leading edge of said articles in said stack and defining with the other face of said drive belt a delivery passage for passage of said articles from said input stage to said delivery stage;

a mechanical separator means mounted in said delivery passage for engaging articles passing through said passage to inhibit the transfer of more than one article and prevent the transfer of more than two articles through said passage; and a suction separator means facing the other face of said belt for holding at said second sensor means any second article that inadvertently passes said mechanical separator means.

7. A singler device according to claim 1, wherein T1 is a first time interval substantially equal to the difference between a predetermined minimum time interval corresponding to a minimum distance between first and second articles and a time interval corresponding to the time necessary to transport said second article from said first sensor means to said second sensor means and T2 is a second time interval substantially equal to the difference between said predetermined minimum time interval and the time interval corresponding to the time necessary to transport said second article from its position at said first sensor means to said second sensor means.

* * * * *

UNITED STATES PATENT AND TRADEMARK OFFICE

CERTIFICATE OF CORRECTION

PATENT NO. : 4,357,007

DATED : November 2, 1982

INVENTOR(S) : Willy A. Mens Franciscus-Ludovicus Van Dorst

It is certified that error appears in the above—identified patent and that said Letters Patent is hereby corrected as shown below:

Change first-listed inventor's name from "Willy A. Mens Franciscus" to --Willy A. Franciscus Mens--.

Signed and Sealed this

*Eighteenth* Day of *January 1983*

[SEAL]

*Attest:*

GERALD J. MOSSINGHOFF

*Attesting Officer*

*Commissioner of Patents and Trademarks*